US005531207A

United States Patent [19]

Lin

[11] Patent Number: 5,531,207

[45] Date of Patent: Jul. 2, 1996

[54] MULTI-STEP ENGINE AIR INTAKE VOLUME CONTROL DEVICE

[76] Inventor: Jung-Chih Lin, No. 48, Sec. 2, Kan-Yuan St., Shulin Town, Taipei County, Taiwan

[21] Appl. No.: 498,114

[22] Filed: Jul. 5, 1995

[51] Int. Cl.[6] ..... F02B 25/06

[52] U.S. Cl. ..... 123/572; 123/184.21

[58] Field of Search ..... 123/184.21, 572, 123/573, 574

[56] References Cited

U.S. PATENT DOCUMENTS

| | | | |
|---|---|---|---|
| 4,624,228 | 11/1986 | Sahara et al. | 123/572 |
| 4,862,860 | 9/1989 | Shinohara | 123/572 |
| 4,922,882 | 5/1990 | Topfer | 123/572 |
| 5,027,783 | 7/1991 | Von Riesen | 123/572 |
| 5,117,782 | 6/1992 | Bischoff et al. | 123/184.21 |
| 5,235,938 | 8/1993 | Haussmann et al. | 123/572 |
| 5,417,195 | 5/1995 | Tachikawa et al. | 123/184.21 |

*Primary Examiner*—Marguerite McMahon

*Attorney, Agent, or Firm*—Morton J. Rosenberg; David I. Klein

[57] ABSTRACT

A multi-step engine intake air volume control device including a casing having an air input port and an air output port, an air filter element to filter air passing from the air input port to the air output port, a plurality of guide tubes respectively connected to the air output port of the casing, a plurality of electromagnetic valves controlled to open/close the guide tubes respectively, a manifold pipe installed in the positive crankcase ventilating system of the motor vehicle to guide air from the guide tubes into the engine of the motor vehicle, and a control circuit connected to the speedometer of the motor vehicle and controlled to alternatively close/open the electromagnetic valves subject to the revolving speed of the engine.

5 Claims, 6 Drawing Sheets

MULTI-STEP ENGINE AIR INTAKE VOLUME CONTROL DEVICE

BACKGROUND OF THE INVENTION

The present invention relates to a control device for regulating the volume of air to the engine of a motor vehicle, and relates more particularly to such a control device which automatically regulate the air intake volume of the engine subject to its revolving speed.

Regular motor vehicles commonly burn fuel oil to move the engine. Before burning fuel oil, a proper amount of air must be mixed with fuel oil for a complete combustion. Various economizers have been developed for improving the performance of the engine. However, regular economizers cannot automatically regulate the intake volume of air subject to the revolving speed of the engine. When a big volume of air is supplied to the engine as the engine is operated at a low speed mode, the horsepower of the engine will be relatively reduced. On the contrary, if a small volume of air is supplied to the engine as the engine is operated at a high speed mode, an incomplete combustion problem will occur, and a big amount of waste gas will be inevitably produced.

SUMMARY OF THE INVENTION

The present invention has been accomplished to provide a multi-step engine intake air volume control device which eliminates the aforesaid problems.

According to the present invention, the multi-step engine intake air volume control device comprises a casing having an air input port and an air output port, an air filter element to filter air passing from the air input port to the air output port, a plurality of guide tubes respectively connected to the air output port of the casing, a plurality of electromagnetic valves controlled to open/close the guide tubes respectively, a manifold pipe installed in the positive crankcase ventilating system of the motor vehicle to guide air from the guide tubes into the engine of the motor vehicle, and a control circuit connected to the speedometer of the motor vehicle and controlled to alternatively close/open the electromagnetic valves subject to the revolving speed of the engine.

DETAILED DESCRIPTION OF THE PREFERRED EMBODIMENT

Figure 1:
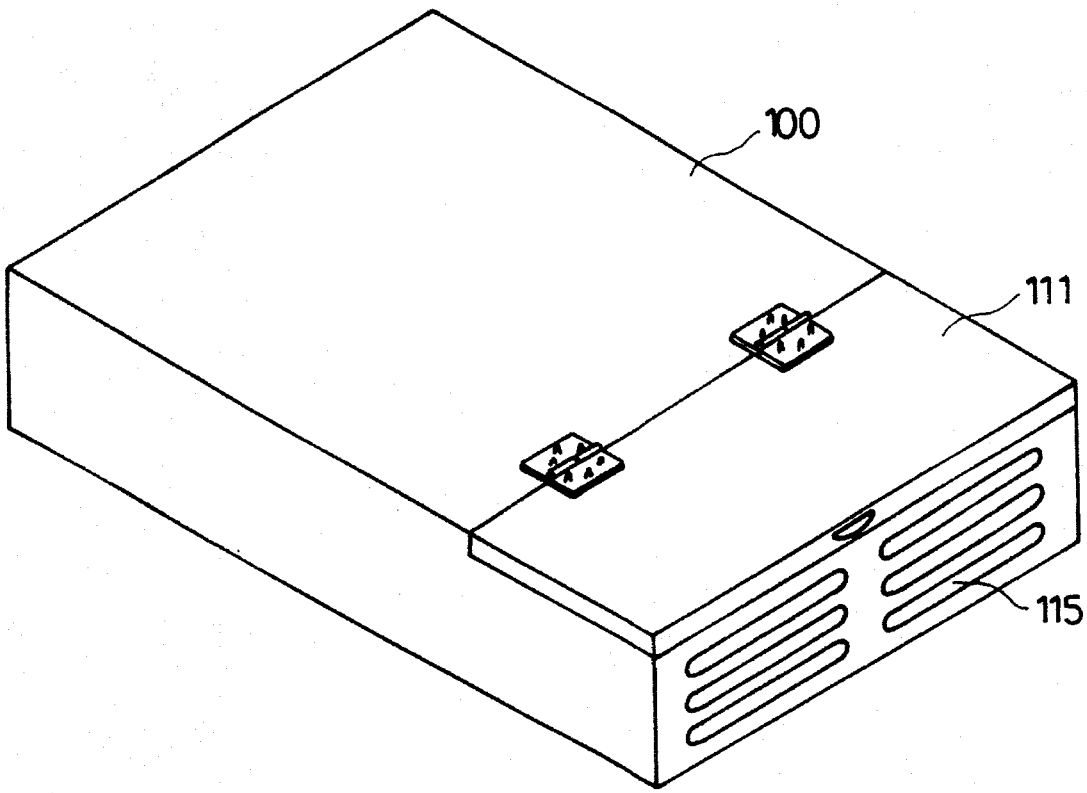
FIG. 1 is an elevational view of a multi-step engine air intake volume control device according to the present invention.
Figure 2:
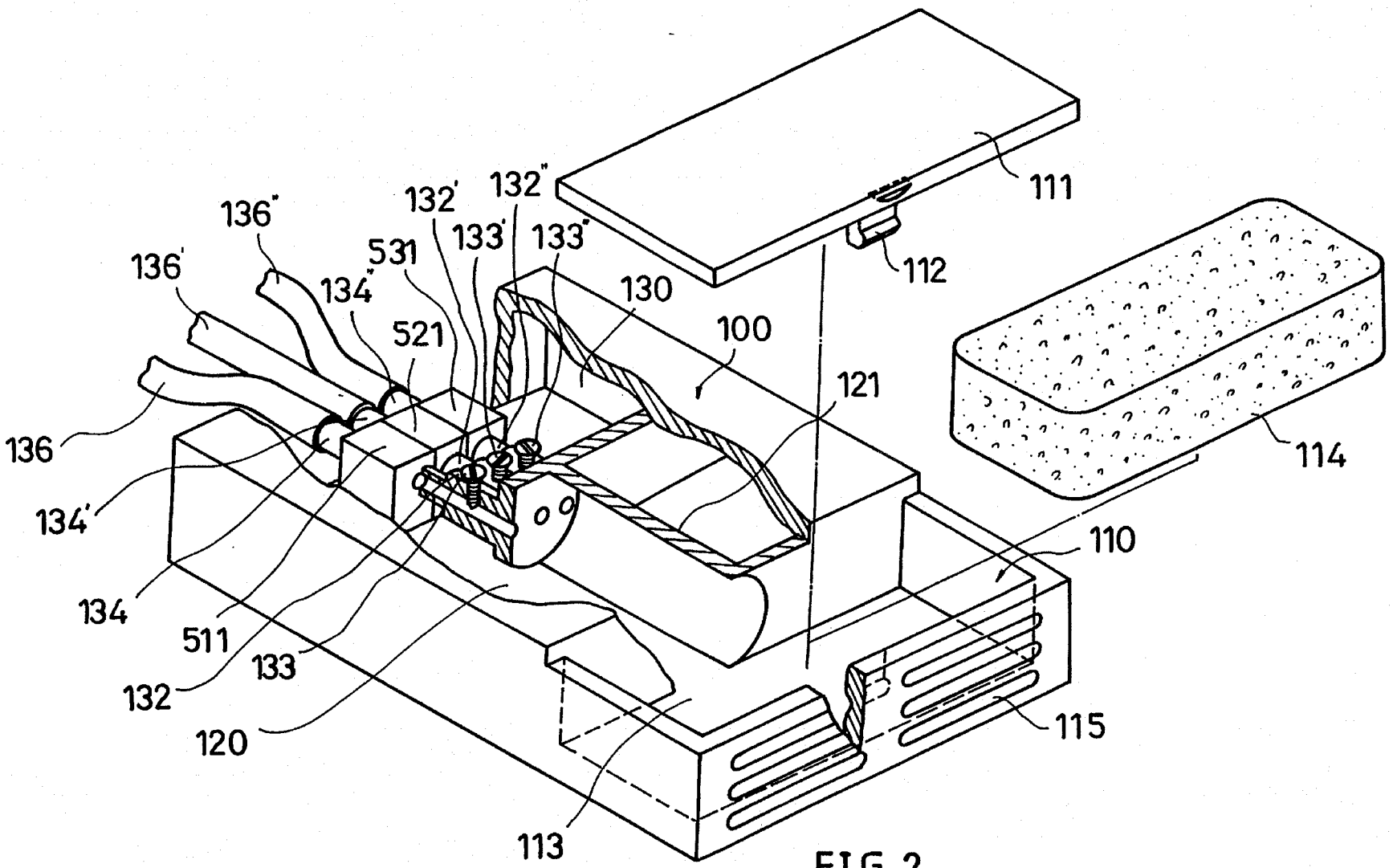
FIG. 2 is a cutaway and partially exploded view of the multi-step engine air intake volume control device shown in FIG. 1.

Referring to FIGS. 1 and 2, the body, referenced by 100, of the multi-step engine intake air control device is comprised of a casing 110, a control chamber 130, and a duct 120 communicated between the casing 110 and the control chamber 130. The casing 110 defines an open chamber 113, which receives an air filter element, for example, a sponge 114. A cover 111 is hinged to the casing 110 and covered on the open chamber 113 over the air filter element 114. The cover 111 has at least one hook 112 opposite to its hinged side for hooking on the inside of the casing 110 to hold the cover 111 in the closed position. The casing 110 further has a plurality of air intake holes 115 at suitable locations.

Figure 3:
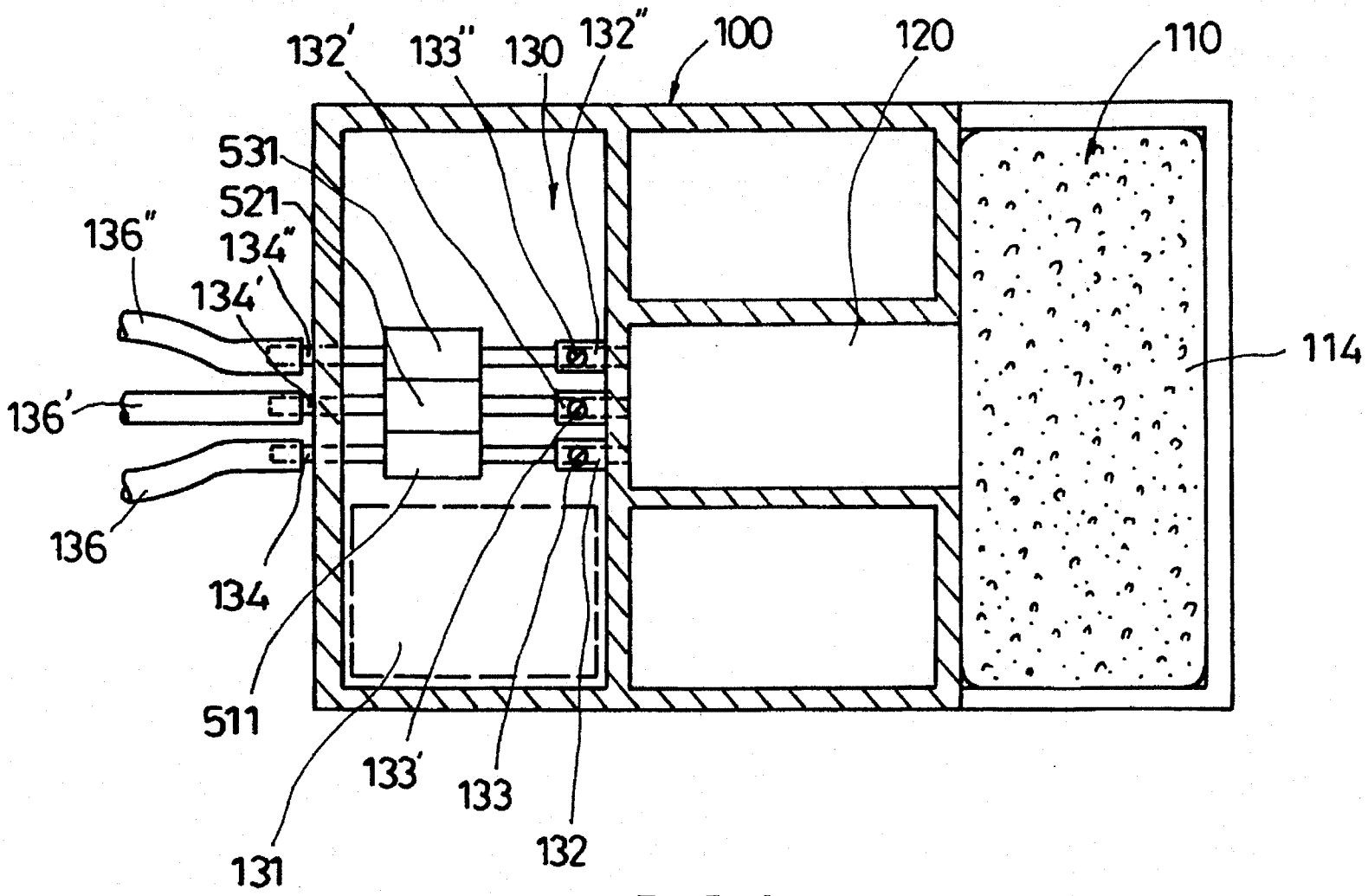
FIG. 3 is a sectional plan view of the multi-step engine air intake volume control device shown in FIG. 1.
Figure 4:
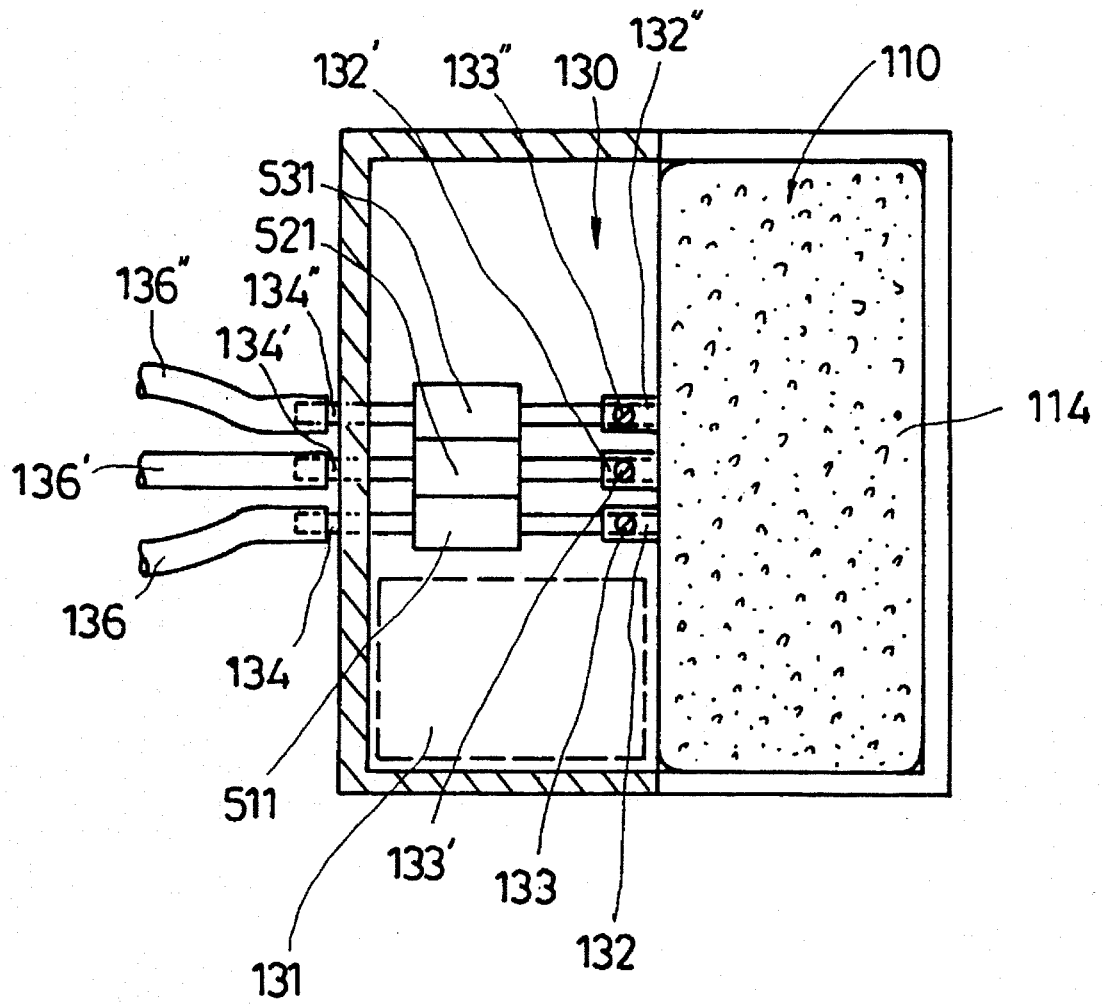
FIG. 4 is a sectional plan view of an alternate form of the multi-step engine air intake volume control device according to the present invention.
Figure 5:
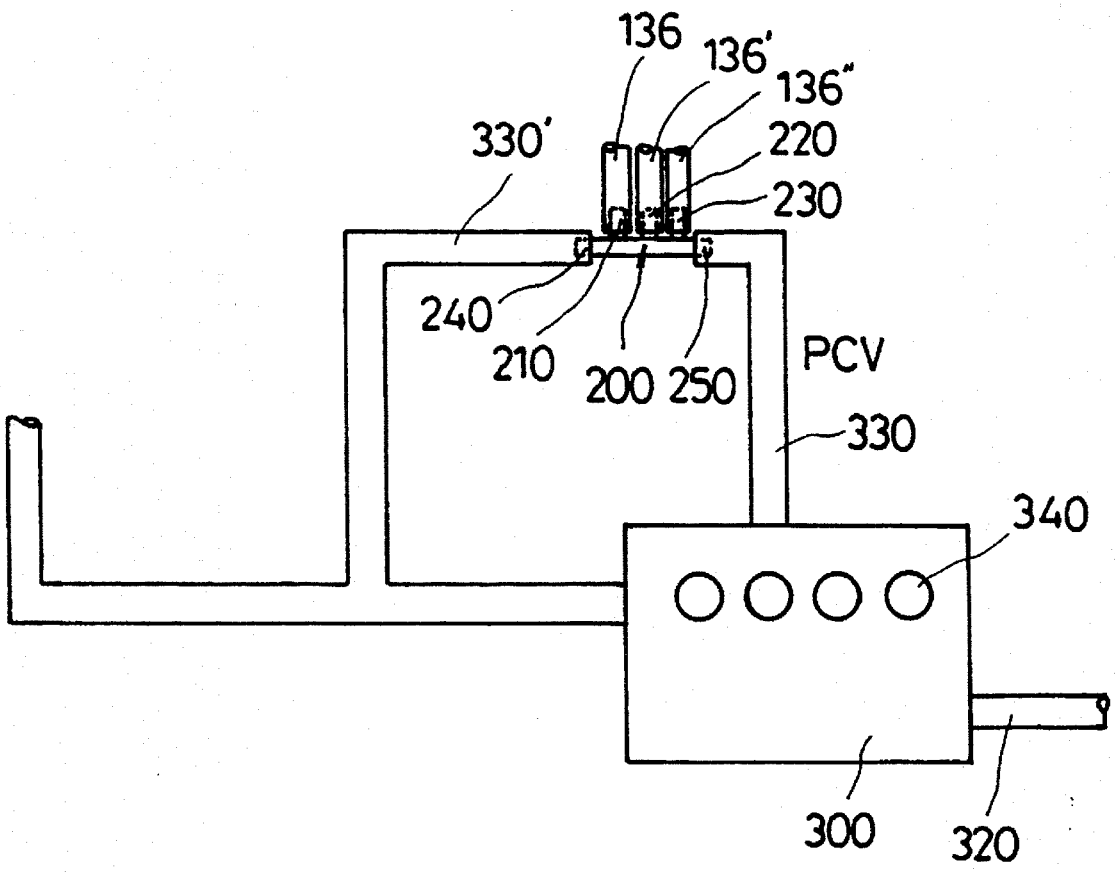
FIG. 5 is a plan view of a portion of the multi-step engine air intake volume control device of the present invention shown installed in PCV (positive crankcase ventilating) system.

Referring to FIGS. 3, 4, and 5, and FIG. 2 again, the control chamber 130 has a control circuit board 131 and three guide tubes 132, 132' and 132" on the inside. The three guide tubes 132, 132' and 132" are respectively connected to the duct 120 at one end remote from the open chamber 113 of the casing 110 and mounted with a respective adjustment screw 133, 133', or 133". The adjustment screws 133, 133' and 133" are to regulate the air flow rates of the guide tubes 132, 132' and 132". Electromagnetic valves 511, 521, and 531 are respectively installed in the guide tubes 132, 132', and 132" for controlling the respective air passage through each guide tube 132, 132' or 132". Three connecting tubes 136, 136', and 136" are respectively connected to the electromagnetic valves 511, 521, and 531 opposite to the guide tubes 132, 132', and 132" by a respective pipe connector 134, 134', or 134 . The opposite ends of the connecting tubes 136, 136', and 136" are respectively connected to the first branch pipe 210, second branch pipe 220 and third branch pipe 230 of the five-way manifold pipe 200. The fourth branch pipe 240 and fifth branch pipe 250 of the five-way manifold pipe 200 are respectively connected between two pipe sections 330 and 330' of a PCV (positive crankcase ventilating system). Therefore, engine 300 receives fresh air from air intake pipe 310 and expels exhaust gas through the exhaust pipe 320, and PCV pipe sections 330 and 330' also guides fresh air to the combustion chambers in the plugs 340 of the engine 300.

Figure 6:
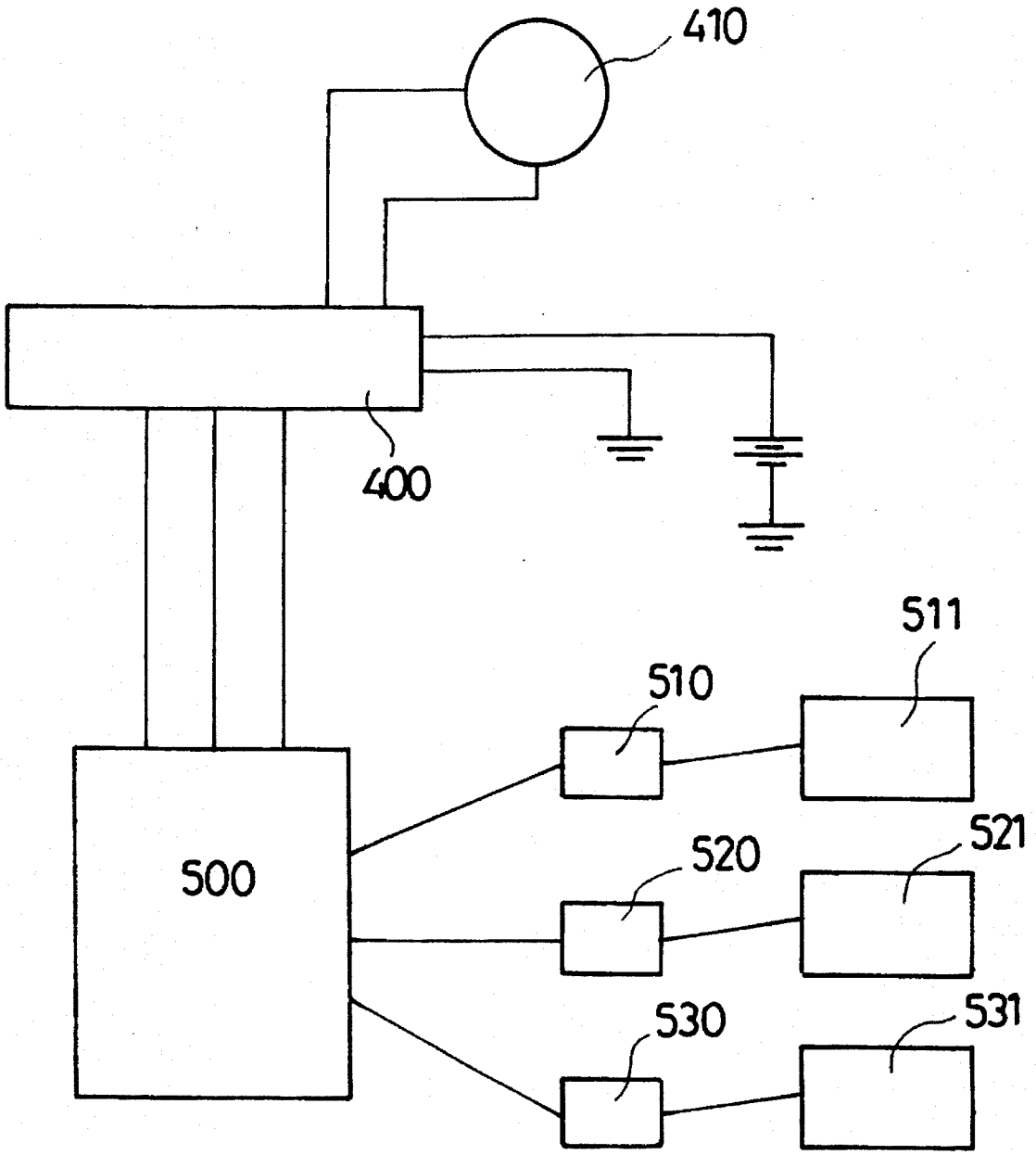
FIG. 6 is a circuit block diagram according to the present invention.

In a motor vehicle, the speedometer is connected to battery and simultaneously connected to the ignition coil, so that the ignition speed can be displayed through the speedometer. Regular speedometers commonly use pointer or LED, or both pointer and LED to show r.p.m. The circuit diagram of the multi-step engine air intake volume control device is shown in FIG. 6. As illustrated in FIGS. 2 and 6, the control & driving circuit 500 of the multi-step engine air intake volume control device of the present invention is installed in the body 100 on the inside and connected to the engine ignition coil 410 through the speedometer 400 to receive the revolving speed signal from it for controlling the operation of the electromagnetic valves 511, 521 and 531 through respective relays 510, 520 and 530. The electromagnetic valves 511, 521 and 531 are controlled to open/close the connecting tubes 136, 136' and 136" so as to regulate the volume of engine intake air. For example, when the engine is started, the first electromagnetic valve 511 is opened to let fresh air pass through the body 100 to the engine; when the revolving speed of the engine is increased to 1000 r.p.m., the second relay 520 is driven to open the second electromagnetic valve 521 for letting more fresh air to be guided to the engine; when the revolving speed of the engine is increased to 200 r.p.m., the third relay 530 is driven to open the third electromagnetic valve 531 for letting more fresh air to pass through the body 100 to the engine.

Referring to FIGS. 2, 3, 5 and 6 again, when outside air is guided through the front open chamber 110 into the duct 120, it is filtrated through the air filter element 114, and then controlled by the control & driving circuit 500 through the electromagnetic valves 510, 520 and 530 to pass through the connecting tubes 136, 136' and 136" to the engine 300. The adjustment screws 133, 133' and 133" can be controlled to regulate the air flow rates of the connecting tubes 136, 136' and 136" respectively.

As indicated, different volumes of air are supplied to the engine subject to its revolving speed so that the performance of the engine can be greatly improved while fuel oil consumption is saved. When the engine is operated at a low speed mode, the first relay 510 is driven to open the first electromagnetic valve 511 for letting a small volume of air pass to the engine; when the engine is operated at a medium speed mode, the first relay 510 and the second relay 520 are driven to open the first electromagnetic valve 511 and the second electromagnetic valve 521 respectively for letting a medium volume of air pass to the engine; when the engine is operated at a high speed mode, the first relay 510 and the second relay 520 and the third relay 530 are driven to open the first electromagnetic valve 511 and the second electromagnetic valve 521 and the third electromagnetic valve 531 for letting a high volume of air pass to the engine. Alternatively, the multi-step engine intake air volume control mode can be set in such a manner that: when the engine is operated at a low speed mode, the first relay 510 is driven to open the first electromagnetic valve 511 for letting a small volume of air pass to the engine; when the engine is operated at a medium speed mode, the first relay 510 and the third relay 530 are turned off to close the first electromagnetic valve 511 and the third electromagnetic valve 531, and the second relay 520 is turned on to open the second electromagnetic valve 521 for letting a medium volume of air pass to the engine; when the engine is operated at a high speed mode, the first relay 510 and the second relay 520 are turned off to close the first electromagnetic valve 511 and the second electromagnetic valve 521, and the third relay 530 is turned on to open the third electromagnetic valve 531 for letting a high volume of air pass to the engine. When this alternate control mode is employed, the air flow rates of the connecting tubes 136, 136' and 136" must be respectively regulated by the respective adjustment screws 132, 132' and 132" for permitting the air flowrate of the third connecting tube 136" to be bigger than the combined air flowrate of the first connecting tube 136 and the second connecting tube 136' and the air flowrate of the second connecting tube 136' to be bigger than that of the first connecting tube 136.

FIG. 4 shows an alternate form of the present invention, in which the aforesaid duct 120 is eliminated, and the guide tubes 132, 132' and 132" are directly connected to the casing 110.

It is to be understood that the drawings are designed for purposes of illustration only, and are not intended as a definition of the limits and scope of the invention disclosed.

I claim:

1. A multi-step engine intake air volume control device installed in the positive crankcase ventilating system of a motor vehicle and controlled to regulate the volume of supply air to the engine of the motor vehicle, the device comprising:

a casing covered with a hinged cover, said casing having an air input port and an air output port;

an air filter element mounted inside said casing to filter air passing from said air input port to said air output port;

a control chamber connected to said air output port, said control chamber comprising a plurality of guide tubes respectively connected to said air output port, a plurality of electromagnetic valves controlled to open and close said guide tubes respectively, a plurality of connecting tubes connected between said guide tubes and respective branch tubes of a manifold pipe being installed in said positive crankcase ventilating system; and, a control circuit connected to the speedometer of the motor vehicle and controlled to alternatively close and open said electromagnetic valves subject to the revolving speed of the engine.

2. The multi-step engine intake air volume control device of claim 1 wherein said guide tubes are respectively mounted with a respective adjustment screw for regulating the volume of air passing through each guide tube.

3. The multi-step engine intake air volume control device of claim 1 wherein said casing and said control chamber are connected together and fixed to the body of the motor vehicle.

4. The multi-step engine intake air volume control device of claim 1 wherein said control circuit comprises a plurality of signal input terminals respectively connected to different contacts at the speedometer and triggered at different engine revolving speeds to control said electromagnetic valves respectively.

5. The multi-step engine intake air volume control device of claim 1 further comprising an air duct connected between said guide tubes and the air output port of said casing.

* * * * *